United States Patent [19]

Harman

[11] Patent Number: 4,612,536

[45] Date of Patent: Sep. 16, 1986

[54] DUAL VELOCITY LEAKY CABLE INTRUSION DETECTOR SENSOR

[75] Inventor: R. Keith Harman, Kanata, Canada

[73] Assignee: Senstar Security Systems, Corporation, Ontario, Canada

[21] Appl. No.: 656,929

[22] Filed: Oct. 2, 1984

[51] Int. Cl.[4] ..... G08B 13/18

[52] U.S. Cl. ..... 340/552; 333/237; 343/5 PD

[58] Field of Search ..... 340/552, 553, 554; 343/5 PD, 7.7; 333/237, 240, 1

[56] References Cited

U.S. PATENT DOCUMENTS

| | | | |
|---|---|---|---|
| 4,091,367 | 5/1978 | Harman | 343/5 PD |
| 4,213,123 | 7/1980 | Poirier | 340/552 |
| 4,415,885 | 11/1983 | Mongeon | 340/553 |
| 4,562,428 | 12/1985 | Harman et al. | 340/552 |

FOREIGN PATENT DOCUMENTS 1014245 7/1977 Canada .

OTHER PUBLICATIONS

Harman, R. K. et al., "Advancements in Leaky Cable Technology for Intrusion Detection" Carnahan Conf. on Security Tech., U. of Kentucky, May 12–14, 1982.

*Primary Examiner*—Glen R. Swann, III
*Attorney, Agent, or Firm*—Antonelli, Terry & Wands

[57] ABSTRACT

A sensor for use in a leaky cable intrusion system which is comprised of a pair of parallel buried coaxial cables, each of which has a velocity of propagation factor different from the other. This results in different sensitivity characteristics with length, resulting in a combined sensitivity which has markedly reduced amplitude variation over cables having similar velocities of propagation. It also makes feasible a system having ungraded cables in which the position of intrusion in the field set up by the sensor can be determined.

22 Claims, 6 Drawing Figures

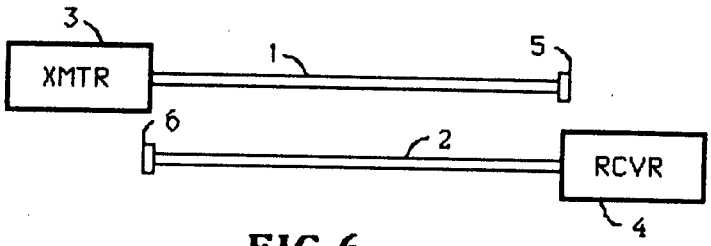
FIG 6
FIG 3
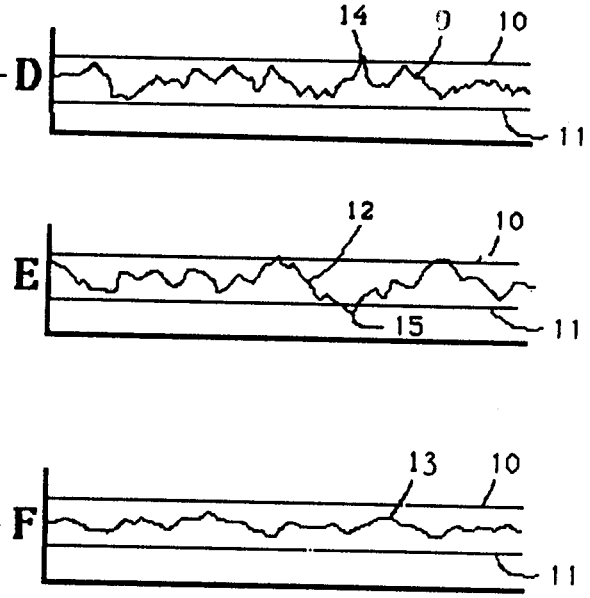

DUAL VELOCITY LEAKY CABLE INTRUSION DETECTOR SENSOR

BACKGROUND OF THE INVENTION

This invention relates to intrusion detectors, and particularly to a sensor for use in a leaky cable intrusion detector system.

Leaky cable intrusion detector systems use a pair of transmission cables which leaks electromagnetic radiation. One cable is connected to a transmitter and the other to a receiver. The transmitter applies either a pulsed radio frequency signal or a continuous wave signal to one cable, and the leaked radiation sets up a field which is coupled to the second cable. The resulting signal is detected in the receiver. In the case of an intruder passing into the field, a phase shift or time change of the received signal occurs with respect to transmitted signal, which allows determination of the existence or the location of the intrusion. Such systems are described in the paper by Dr. R. Keith Harman and John E. Siedlarz given to the 1982 Carnahan Conference on Security Technology, at the University of Kentucky, May 12–14, 1982. It should be noted that in some systems the transmitter can be located at one end of one cable, and the receiver at the adjacent end of the other cable, and in other systems the receiver can be located at the remote end of the second cable.

One form of pulsed radio frequency signal leaky cable intrusion detector system is described in Canadian Patent No. 1,014,245 issued July 19th, 1977, invented by Dr. R. Keith Harman. Another system, using continuous wave signals is described in Canadian patent application No. 403,015 filed May 14th, 1982, invented by Dr. R. Keith Harman and Dale R. Younge.

It has been found that a sensitivity problem exists with such systems which use buried parallel leaky coaxial cables as a sensor. It has been found that due to variations in the characteristics of the burial medium (e.g. the earth), the cables exhibit variations in sensitivity along their length. The sensitivity can vary within a relatively short distance from excessive, through normal, to inadequate. In regions of inadequate sensitivity, the presence of an intruder may not be detected. In regions of excessive sensitivity, the presence of a passing automobile or other objects far outside the normal detection range can cause the system to set off an alarm. Such variations in sensitivity are clearly undesirable, and can be fatal to the reliable operation of the system.

The present invention is directed to a sensor for such systems which can substantially reduce the excessive variations in sensitivity.

Further, the use of the present invention creates a detection field which has varying height, in cross-section, which has been found to reduce the possibility of a person passing through the detection field by attempting to remain below the detection threshold, by reducing his body size, i.e. by crouching or "duck walking".

In addition, the present invention makes feasible a leaky cable intrusion system in which the transmitter and receiver are coupled to opposite ends of the corresponding cables, and in which the cables are not graded, yet allows determination of the location of an intrusion along the cables. This is made possible with the use of cables having different velocity of propagation characteristics.

SUMMARY OF THE INVENTION

The present invention utilizes a pair of parallel leaky cables which have different velocity propagation factors. Different velocities of propagation can be obtained in leaky coaxial cables by utilizing different core materials for the two coaxial cables, e.g. solid polyethylene for one cable and foamed or cellular polyethylene for the second cable.

The effect of the above will be understood upon reading the detailed description below.

According to one embodiment of the invention, the sensor is comprised of a radio frequency transmitter, a receiver for receiving the signal, a pair of cables located in parallel and spaced relationship, a first one of which is coupled to the transmitter for radiating the signal along its length, and the other being coupled to the receiver for receiving the radiated signal along its length from the first cable, the velocities of propagation of the cables being different from each other.

The transmitter can supply either a pulsed radio frequency signal a continuous wave signal. The transmitter and receiver can be either at adjacent ends of the cables or at mutually opposite ends. An advantage in the case of the receiver being at opposite ends is that the cables need not be graded, i.e., that the radio frequency field leakage need not increase along the cables, as is desirable when the receiver and transmitter are at adjacent ends of the cables.

According to another embodiment of the invention, the sensor is comprised of a pair of leaky coaxial cables disposed in parallel but spaced relationship, each having varying lengthwise sensitivity (due to ambient factors such as discontinuities in the burial medium), in which the cables have differing electrical characteristics sufficient to cause the varying sensitivity characteristics along their length to be different from each other. This results in the peaks and valleys of their combined sensitivies to be reduced in amplitude relative to the case having the cables with similar lengthwise sensivitivity characteristics.

According to a further embodiment of the invention, the sensor is comprised of a pair of leaky cables which are disposed in parallel but spaced relationship. A radio frequency field is set up around one of the cables by applying a radio frequency signal to the cable. The field is intercepted by the other cable. The structure of the cable causes the sensitivity of one of the cables to be smaller than the sensitivity of the other.

BRIEF DESCRIPTION OF THE DRAWINGS

A better understanding of the invention will be obtained by reference to the detailed description below, with reference to the following drawings, in which:

FIG. 3 depicts the sensitivity of the two parallel cables and their combined sensitivity in accordance with the present invention respectively in graphs B, E and F, FIG. 6 illustrates another embodiment of the invention.

DESCRIPTION OF THE PREFERRED EMBODIMENT

Figure 1:
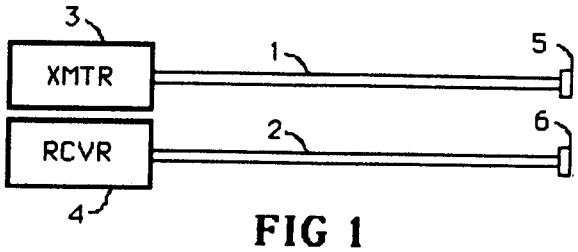
FIG. 1 illustrates a block diagram of the invention.

Turning first to FIG. 1, the preferred embodiment of the invention is shown. The sensor can be used for example in the SENTRAX TM perimeter intrusion detector security system sold by Senstar Corporation of Kanata, Ontario, Canada, or can be used in the GUIDAR TM system manufactured by Control Data Corporation in Nepean, Ontario, Canada. The system itself is well known and therefore will not be described, since the present invention is directed to a novel sensor which can be used therein.

In FIG. 1, a pair of leaky coaxial cables 1 and 2 are buried parallel to each other in accordance with such systems, e.g. approximately 6 inches to 1 foot deep, approximately 1 to 6 feet apart; each allows an electromagnetic field to pass through its shield. A pulsed radio frequency or continuous wave signal transmitter 3 (e.g. of 60 or 40 MHz respectively) is connected to, or is in circuit communication with the end of one cable 1, and a receiver 4 is connected to, or is in circuit communication with an adjacent end of the parallel leaky coaxial cable 2. Each of the cables is terminated by a terminating resistor 5 and 6 respectively.

Such cables are normally graded, i.e. the leakage of the cables 1 and 2 increases with distance from the transmitter and receiver. The reason for the grading is to reduce decreasing sensitivity with distance from transmitter and receiver.

Figure 4:
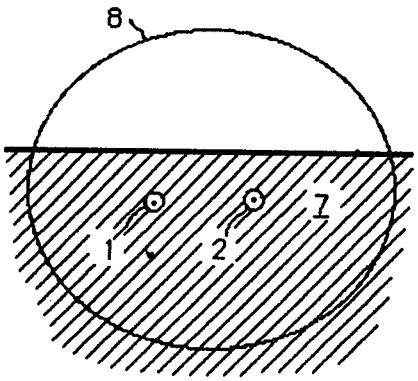
FIG. 4 is a cross section of the detection zone of a sensor in accordance with the prior art.

In cross section, the field produced by the parallel cables is shown in FIG. 4. The cables 1 and 2 are buried in a burial medium 7, i.e. the earth, concrete, or the like. An electromagnetic field having a nominal boundary 8 above and below the earth is set up. It should be noted that the distance between the cables 1 and 2 and between the cables and the surface of the earth has been exaggerated for clarity. Typically the boundary 8 will be 3 to 4 feet high.

Figure 2:
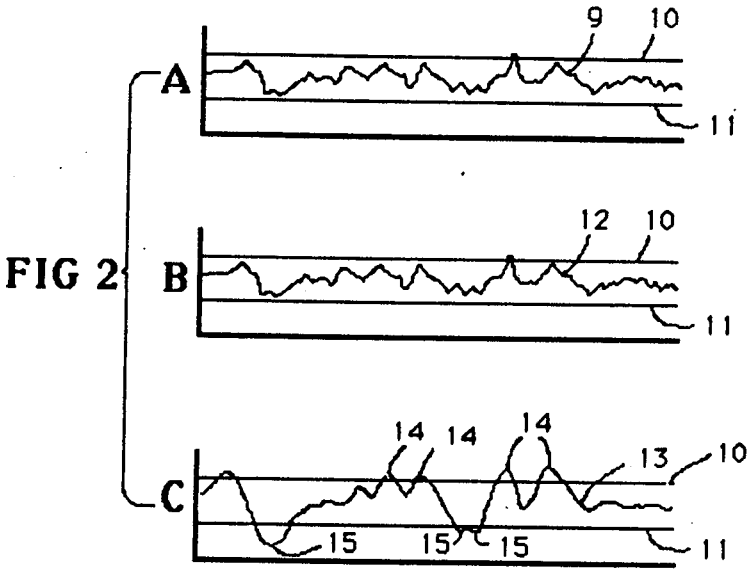
FIG. 2 depicts the sensitivity of each of the two cables, and of the combined sensitivity in accordance with the prior art, respectively in graphs A, B and C.

FIG. 2, graph A, illustrates typical sensitivity 9 (shown along the ordinate) with length of one of the cables (shown along the abscissa). It may be seen that the sensitivity varies substantially with distance. Upper and lower thresholds 10 and 11 distinguish the excessive and insufficient sensitivity levels along the cables.

With the second cable being buried parallel to and in relatively close proximity to the first, it has been found that the sensitivity of the second cable varies very similarly to the first since the burial medium encompassing both is similar. The identical sensitivity of the second cable is shown as reference numeral 12, within upper and lower thresholds 10 and 11.

The result is a combined sensitivity which is shown in graph C. The sensitivities are additive, resulting in sensitivity curve 13 (curve 13 has been shown for illustration purposes only, and has not been drawn with values being the precise additive value of graphs A and B). Consequently the measured combined sensitivity has been found to be extremely variable along the pair of cables, and indeed at locations 14 have excessive sensitivity, and at locations 15 have insufficient sensitivity. Thus at positions adjacent locations 15 an intruder could conceivably pass through the system without having it set off an alarm, and at locations 14 persons, or even relatively distant vehicles or objects outside the detection zone can cause it to set off an alarm. Thus it may be seen that such prior art systems can exhibit substantial unreliability, depending on the conditions of the burial medium.

In accordance with the present invention, the velocity propagation characteristics of one of the cables is different from that of the other. The effect of this is to shift the sensitivity peaks and valleys of one cable relative to the other. As a result the peaks and valleys of sensitivity of one cable tend not to add to corresponding peaks and valleys of the other cable; the peak sensitivity of one is more likely to add with average or low sensitivity of the other, and the low sensitivity of one cable is more likely to add with the average or peak sensitivity of the other. The result is a more even overall sensitivity of the pair of cables. The preferred amount of shift is of course dependent on the variability of the burial medium.

The effect of this is shown in FIG. 3. Graph D illustrates the sensitivity 9 of the first cable. Graph E illustrates the sensitivity 12 of the second cable. It may be seen that the sensitivity characteristics with length of the two cables are different, rather than identical as in the prior art. The result is a combined sensitivity 13 which is shown in graph F. Excessive sensitivity at reference numeral 14 of sensitivity curve 9 in graph D is reduced in the combined sensor by a lower sensitivity at the same cable distance position from the transmitter and receiver in the second cable, and insufficient sensitivity at the position of reference numeral 15 of sensitivity curve 12 of graph E is increased by a greater sensivitiy at the same cable distance position from the transmitter and receiver in the first cable. As may be seen in graph 13 it has been found that the combined sensitivity shows a more even sensitivity along the cable, well within the upper and lower thresholds 10 and 11.

Figure 5:
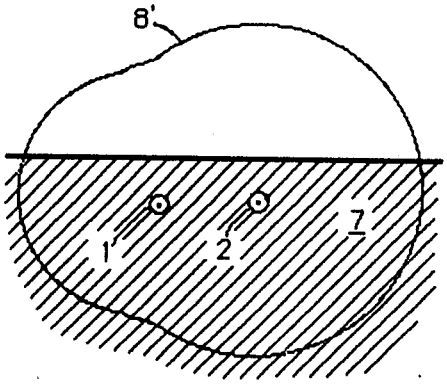
FIG. 5 is a cross section of the detection zone in accordance with the present invention.

FIG. 5 illustrates a cross-section of the nominal field boundary 8 of cables 1 and 2, in which cable 1 supports a lower velocity of propagation than that of cable 2. It may be seen that the nominal field boundary above cable 1 is lower than that of cable 2. This results because the field is concentrated nearer the earth's surface above cable 1. Consequently a person having a small body, i.e. crouching, or duck walking, can be detected more easily within that zone than within the zone above cable 2, due to the higher field concentration nearer the earth's surface.

The cross-sectional variation in nominal field boundary above the two cables has been found to have a substantial advantage. As noted above, it can more easily facilitate the detection of small bodies. In addition, if an intruder believes that there is a relatively low field boundary and attempts to jump over it, he will be apt to jump directly into the higher field above the higher velocity cable 2.

In general, it is preferred that in installations in which the cables are run parallel to a single fence, the lower velocity cable should be located on the fence side. In an open area, it is preferable to place the lower velocity cable on the same side where the threat approaches the sensor. In this way the jumping projectory of an intruder is more likely to be detected.

It should be noted that the dual velocity cables can also be used in systems in which the transmitter and receiver are respectively located at opposite ends of the two cables, as shown in FIG. 6. Such a leaky cable system does not require graded cables, since the reducing field strength due to non-grading along cable 1 is compensated by the increasing sensitivity of receiving cable 2 at a corresponding position, looking in the same direction. Thus the two cables compensate each other. This is opposite to the effect of the embodiment shown in FIG. 1, in which the cables 1 and 2 must be graded with increasing leakage from the positions of the transmitter and receiver. Thus in the cables of FIG. 6 the leakage factor of the cables along their length can be constant.

Systems which had the transmitter at one end of one cable and the receiver at the opposite end of the other cable as in FIG. 6, but with both cables identical (having similar velocities of propagation) and ungraded inherently could not identify the location of an intrusion, because the path length from the transmitter to the receiver through the intrusion point was always virtually a constant. The use of dual velocity cables for the two leaky cables in the sensor, however, now allows identification of the point of the intrusion. For example, the leaky cable coupled to the transmitter has the higher velocity, clearly the intrusion location will be detected earlier in phase if it occurs close to the receiver than if it occurs close to the transmitter. Thus the receiver need only measure the phase or time shift of the intrusion point of the received signal relative to the transmitted signal as in the prior art, in the system of FIG. 6, but using the dual velocity leaky cables, in order to determine the location of the intrusion. This is a significant advance in the art, since for the first time such systems which have the transmitter coupled to one end of one ungraded cable and the receiver coupled to the opposite end of the other ungraded cable can determine the intrusion point. Ungraded cables are of course significantly less costly than graded cables; the sensor cost is thus substantially reduced for a system which can determine the location of the intrusion.

For single sector zones in the dual velocity leaky cable system of FIG. 6, it is preferred that the cable length should provide no more than a 360° phase shift of the transmitted signal over its length. Determination of the phase or time shift point from the transmitted signal in the receiver will then provide an unambiguous determination of the position of the intrusion along the cables, since the phase or time shift is related to the distance from the transmitter along the cables. The cable length can be determined from the following:

$$360^\circ = \left(\frac{1}{\tau_1} - \frac{1}{\tau_2}\right) 2\pi L$$

in which $\tau_1$ and $\tau_2$ are the wavelengths of the transmitted signal in the lower and higher velocity cables respectively, and L is the length of the cable.

$$\tau_1 = \frac{K_1 C}{f}, \text{ and } \tau_2 = \frac{K_2 C}{f},$$

in which K represents the velocity of the signal relative to the velocity of light.

In the case of a solid polyethylene core leaky coaxial cable, a velocity of propagation is given as 0.66 of the velocity of light, while in a foamed polyethylene core leaky coaxial cable, a propagation velocity is given as 0.79 of the velocity of light.

For a pair of cables in which one has a solid polyethylene core and the other has a foamed polyethylene core, in which the system operates at 40 megahertz, to obtain a 360° phase shift over the length, the cable length would be approximately 150 feet.

The two velocity leaky cable sensor has been found to substantially increase the reliability of leaky cable intruder detector systems, decreasing the amount of false alarm investigations required, and thus the cost of operation. It further makes installations of such systems feasible in locations which previously exhibited excessive false alarms, due to burial medium conditions causing excessive sensitivity variations in the sensor. In addition, it makes determination of the intrusion point feasible in systems in which the transmitter is coupled to one end of one cable and the receiver is coupled to the opposite end of the other cable of the sensor.

A person skilled in the art understanding this invention may now conceive of variations or other embodiments using the principles of the invention. All are considered to be within the scope of the invention as defined in the claims appended hereto.

I claim:

1. A sensor for use in a leaky cable intrusion detector system comprising:

(a) a radio frequency signal transmitter, (b) a receiver for receiving said signal, and (c) a pair of cables for location in parallel but spaced relationship, a first one of which is adapted to be coupled to the transmitter for radiating the signal along its length, and the other being adapted to be coupled to the receiver for receiving the radiated signal along its length from the first cable, the velocity propagation factors of the cables being different from each other.

2. A sensor as defined in claim 1 in which the cables are leaky coaxial cables.

3. A sensor as defined in claim 2 in which the transmitter and receiver are connected to adjacent ends of the cables.

4. A sensor as defined in claim 2 in which the transmitter and receiver are connected to ends of the respective cables opposite each other.

5. A sensor as defined in claim 3 in which the cables are graded.

6. A sensor as defined in claim 4 in which the cables are ungraded, having constant leakage per unit length.

7. A sensor as defined in claim 1, 5 or 6 in which the transmitter is a pulsed radio frequency signal transmitter.

8. A leaky cable system as defined in claim 1, 5 or 6 in which the transmitter is a continuous wave signal transmitter.

9. A sensor for use in a leaky cable intrusion detector system comprising:

(a) a pair of leaky cables disposed in parallel but spaced relationship, (b) means for establishing a radio frequency field around one of the cables, (c) means for receiving the field by the other of the cables, and (d) means for causing the field sensitivity of one of the cables to be smaller than the field sensitivity of the other.

10. A sensor as defined in claim 9, in which said cables are coaxial cables, and in which said means for causing is comprised of core materials within the pair of cables being different whereby different velocities of propagation of said field are exhibited in the cables.

11. A sensor for use in a leaky cable intrusion detector system comprising:

(a) a pair of leaky coaxial cables disposed in parallel but spaced relationship, each exhibiting varying sensitivity along its length, (b) the cables having differing electrical characteristics whereby their varying sensitivities along their lengths are caused to be different from each other.

12. A sensor as defined in claim 11 in which said characteristics are their radio frequency velocity propagation factors.

13. A sensor for use in a leaky cable intrusion detection system comprising:

(a) a pair of parallel buried leaky coaxial cables, (b) a radio frequency signal transmitter in communication with one end of one of the cables, for setting up an electromagnetic field around the cable, (c) a receiver in communication with one end of the other of the cables, for receiving the signal, (d) the cables being spaced so that the field established around said one of the cables is intercepted by the other cable, (e) each of the cables having a core, the material of the cores being different whereby the velocities of propagation of said fields within the cables are different.

14. A sensor as defined in claim 13 in which the core material of one of the cables is solid polyethylene and the core material of the other of the cables is foamed or cellular polyethylene.

15. A sensor as defined in claim 13 or 14 in which the transmitter and receiver are respectively in communication with adjacent ends of said cables, and in which the cables are graded.

16. A sensor as defined in claim 13 or 14 in which the receiver and transmitter are respectively in communication with opposite ends of the cables and in which the cables are not graded, and in which the the lengths of the cables are predetermined such that the phase shift of the field from one pair of adjacent ends to their opposite adjacent ends is no greater than 360°.

17. A sensor as defined in claim 13 or 14 in which the transmitter is a pulsed radio frequency signal transmitter for applying a pulsed radio frequency signal to said one of the cables, and in which the receiver is comprised of means to detect time and/or phase delay variations from the onset of a transmit pulse whereby the location along said cables of a target intruding into said field can be detected, the transmitter and receiver being in communication with adjacent ends of said cables, and the cables being similarly graded.

18. A sensor as defined in claim 13 or 14 in which the transmitter is a continuous wave signal transmitter for applying a continuous wave signal to said one of the cables, and in which the receiver is comprised of means to detect variations in phase of the signal whereby the existence of a target intruding into said field can be detected, the transmitter and receiver being in communication with adjacent ends of said cables, and the cables being similarly graded.

19. A sensor as defined in claim 13 or 14 in which the transmitter is a pulsed radio frequency signal transmitter for applying a pulsed radio frequency signal to said one of the cables, and in which the receiver is comprised of means to detect time and/or phase delay variations from the onset of a transmit pulse whereby the location along said cables of a target intruding into said field can be detected, the transmitter and receiver being respectively in communication with opposite ends of said cables, and the cables being ungraded.

20. A sensor as defined in claim 13 or 14 in which the transmitter is a continuous wave signal transmitter for applying a continuous wave signal to said one of the cables, and in which the receiver is comprised of means to detect variations in phase of the signal whereby the existence of a target intruding into said field can be detected, the transmitter and receiver being respectively in communication with the opposite ends of said cables, and the cables being ungraded.

21. A sensor as defined in claim 13 or 14 in which the receiver and transmitter are respectively in communication with opposite ends of the cables and in which the cables are not graded, and in which the transmitter is a pulsed radio frequency signal transmitter for applying a pulsed radio frequency signal to said one of the cables, and in which the receiver is comprised of means to detect time and/or phase delay variations from the onset of a transmit pulse whereby the location along said cables of a target intruding into said field can be detected, the transmitter and receiver being respectively in communication with opposite ends of said cables, and the cables being ungraded.

22. A sensor as defined in claim 13 or 14 in which the receiver and transmitter are respectively in communication with opposite ends of the cables and in which the cables are not graded, and in which the transmitter is a continuous wave signal transmitter for applying a continuous wave signal to said one of the cables, and in which the receiver is comprised of means to detect variations in phase of the signal whereby the existence of a target intruding into said field can be detected, the transmitter and receiver being respectively in communication with the opposite ends of said cables, and the cables being ungraded.

* * * * *